US011167583B1

(12) United States Patent
Jarzombek et al.

(10) Patent No.: US 11,167,583 B1
(45) Date of Patent: Nov. 9, 2021

(54) COMBINATION THREE POCKET FOLDER AND DOCUMENT STAND

(71) Applicants: Teresa M. Jarzombek, San Antonio, TX (US); Ralph P. Jarzombek, San Antonio, TX (US)

(72) Inventors: Teresa M. Jarzombek, San Antonio, TX (US); Ralph P. Jarzombek, San Antonio, TX (US)

( * ) Notice: Subject to any disclaimer, the term of this patent is extended or adjusted under 35 U.S.C. 154(b) by 0 days.

(21) Appl. No.: 15/154,574

(22) Filed: May 13, 2016

(51) Int. Cl.
*B42F 7/06* (2006.01)
*A47B 23/04* (2006.01)

(52) U.S. Cl.
CPC ..... *B42F 7/06* (2013.01); *A47B 23/044* (2013.01)

(58) Field of Classification Search
CPC .. B42D 1/00; B42D 5/00; A47B 23/00; A47B 23/044; B42F 13/00; B42F 7/06
USPC ..... 281/3.1, 15.1, 33; 402/73, 74, 75, 76, 402/77, 78
See application file for complete search history.

(56) References Cited

U.S. PATENT DOCUMENTS 4,981,386 A * 1/1991 Beleckis ..... B42D 3/123 281/33
2002/0051677 A1* 5/2002 Moor ..... A45C 7/0068 402/73
2010/0187803 A1* 7/2010 Park ..... B42D 1/06 281/33

* cited by examiner

*Primary Examiner* — Justin V Lewis

(57) ABSTRACT

A combination multiple pocket folder and document stand includes a first rising panel having a first edge and a second edge; a second rising panel, having a first edge attached to the second edge of the first rising panel and a second edge; a base panel, having a first edge attached to the second edge of the second rising panel and a second edge; a flap attached to the first edge of the first rising panel and having a tab at a distal edge thereof; and a slot provided along the second edge of the base panel for receiving therein the tab of the flap. The flap, which preferably includes accordion folds, cooperates with the slot to transform the folder into a document stand.

1 Claim, 8 Drawing Sheets

COMBINATION THREE POCKET FOLDER AND DOCUMENT STAND

FIELD OF THE INVENTION

The present invention relates to document and like article organization. More particularly, the invention relates to a three pocket document folder that readily converts to a sturdy and reliable stand for documents or like articles.

BACKGROUND OF THE INVENTION

Students, business persons, and others are often tasked with transporting and managing numerous documents and, in many cases, find a need to access one or more of these documents while utilizing a computer, giving a presentation, playing a musical instrument, or the like. In these cases, it is often desirable to have available a document, or like article, stand. Unfortunately, this generally requires that the already heavily burdened user must transport at least one more item.

With the foregoing clearly in mind, it is therefore an overriding object of the present invention to improve over the prior art by providing a three pocket folder that has all conventionally available features of prior art folders, but that is also readily converted into a document or like article stand.

Additionally, it is an object of the present invention to provide such a combination three pocket folder and document stand that is also specifically adapted to prevent disarray of contained documents, even when used in its document stand configuration.

Still further, it is an object of the present invention that is durable in use, thereby ensuring that the document stand may be readily, and without worry, utilized for supporting such articles as tablet computers and other portable electronic devices.

Finally, it is an object of the present invention to provide such a combination three pocket folder and document stand that is readily and economically manufactured, thereby ensuring its widest availability.

SUMMARY OF THE INVENTION

In accordance with the foregoing objects, the present invention—a combination multiple pocket folder and document stand—generally comprises a first rising panel having a first edge and a second edge; a second rising panel, having a first edge attached to said second edge of said first rising panel and a second edge; a base panel, having a first edge attached to said second edge of said second rising panel and a second edge; means for configuring said folding panels as a document stand; and wherein said folding panels cooperatively define a top edge and a bottom edge of a document folder; each said folding panel comprises a pocket adapted to dependently receive therein a quantity of sheet stock; at least one edge of each said pocket of said rising panels adjacent said base panel runs substantially the distance between said top edge and said bottom edge of said document folder; and at least one edge of each said pocket of said rising panels adjacent said base panel runs substantially the distance between said top edge and said bottom edge of said document folder.

Said means for transforming preferably comprises a flap attached to said first edge of said first rising panel, said flap having a tab at a distal edge thereof; and a slot provided along said second edge of said base panel, said slot being adapted to receive therein said tab of said flap. Said flap also preferably comprises accordion folds, said accordion folds being adapted to form a document tray.

Finally, many other features, objects and advantages of the present invention will be apparent to those of ordinary skill in the relevant arts, especially in light of the foregoing discussions and the following drawings, exemplary detailed description and appended claims.

BRIEF DESCRIPTION OF THE DRAWINGS

Although the scope of the present invention is much broader than any particular embodiment, a detailed description of the preferred embodiment follows together with illustrative figures, wherein like reference numerals refer to like components, and wherein.

DETAILED DESCRIPTION OF THE PREFERRED EMBODIMENT

Although those of ordinary skill in the art will readily recognize many alternative embodiments, especially in light of the illustrations provided herein, this detailed description is exemplary of the preferred embodiment of the present invention, the scope of which is limited only by the claims appended hereto.

Figure 1:
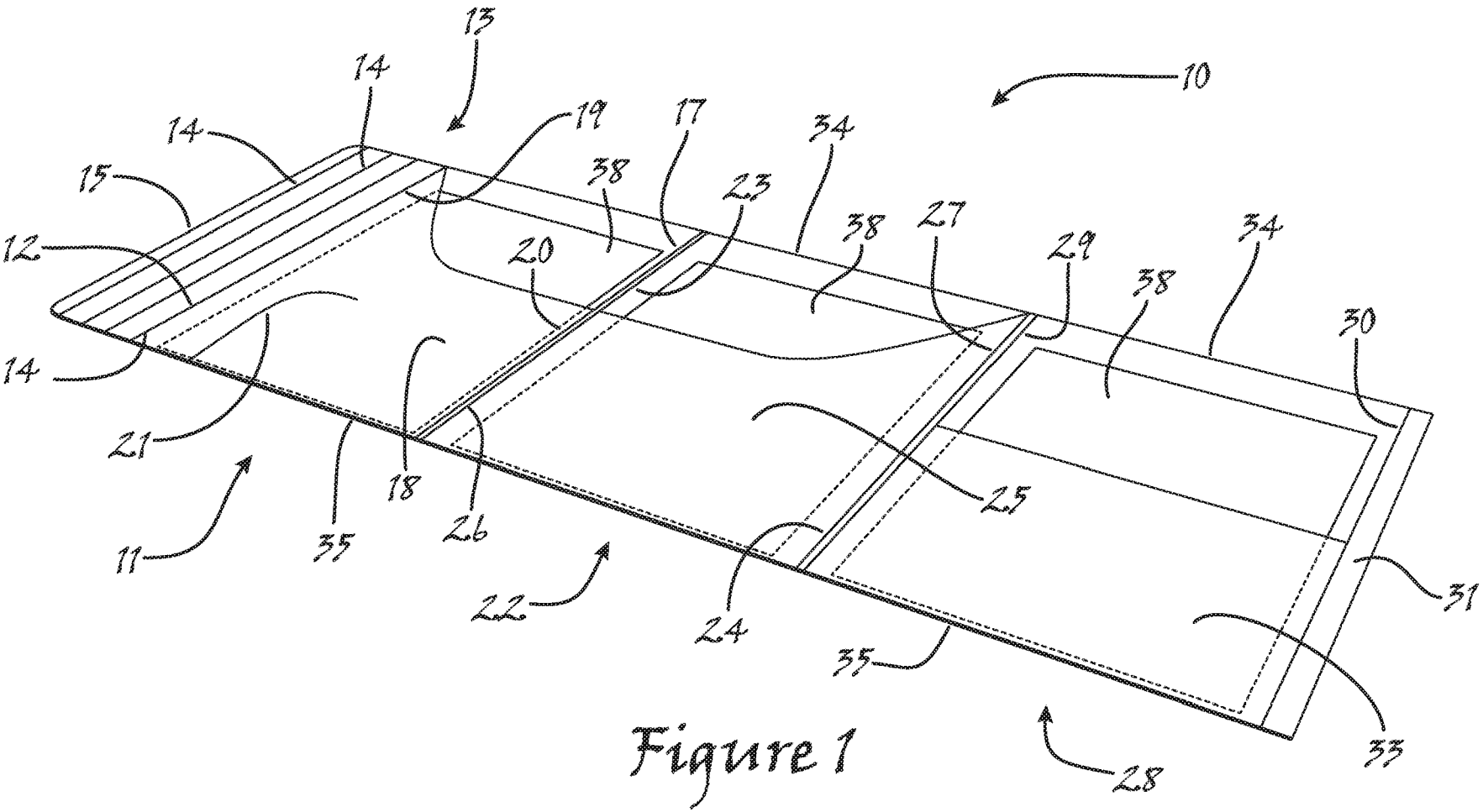
FIG. 1 shows, in a perspective view, the general construction of the most preferred implementation of the combination three pocket folder and document stand of the present invention.
Figure 2:
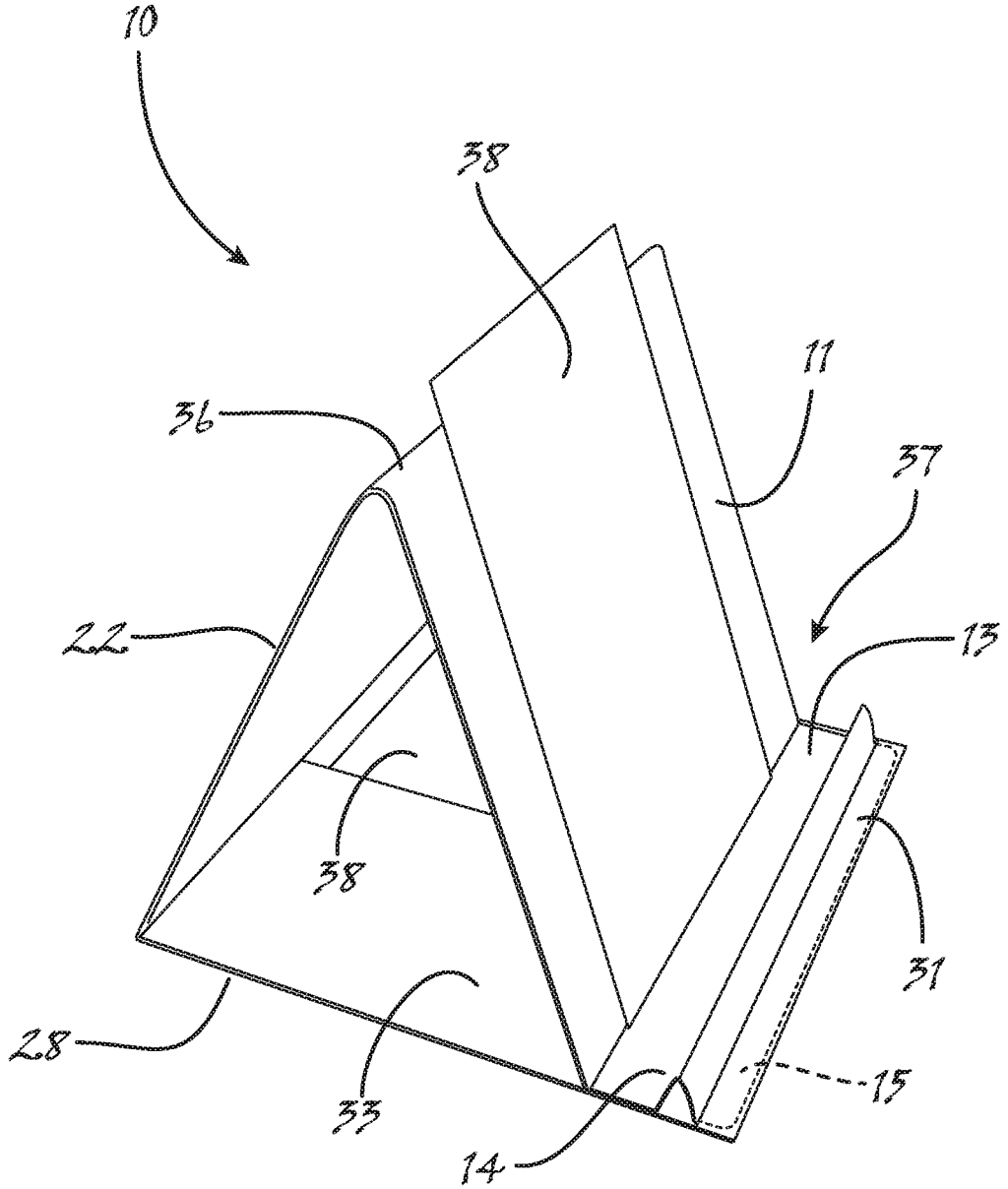
FIG. 2 shows, in a perspective view, the combination three pocket folder and document stand of the present invention, as fully deployed in its document stand configuration.

Referring now to the figures, and to FIGS. 1 and 2 in particular, the most preferred implementation of the combination three pocket folder and document stand 10 of the present invention is shown to generally comprise a plurality of folding panels 11, 22, 28, which, together with other features of the present invention, are cooperatively adapted to form three pocket document folder, as most particularly shown in FIG. 1, that is transformable into a document stand, as most particularly shown in FIG. 2.

Referring specifically now to FIG. 1, the exemplary implementation of the combination three pocket folder and document stand 10 is shown to comprise a first rising panel 11, having a first edge 12 and a second edge 17; a second rising panel 22, having a first edge 23, which is attached to the second edge 17 of the first rising panel 11, and a second edge 24; and a base panel 28, having a first edge 29, which is connected to the second edge 24 of the second rising panel 22, and a second edge 30. The three folding panels 11, 22, 28, connected as described, form a top edge 34 and a bottom edge 35 of the combination three pocket folder and document stand 10, when in the folder configuration generally depicted in FIG. 1.

In accordance with the most preferred implementation of the present invention, each of the three folding panels 11, 22, 28 comprises a pocket 18, 25, 33, respectively, each provided pocket 18, 25, 33 being adapted to dependently receive therein one or more papers 28 or like articles of sheet stock. In an important aspect of the present invention, necessary to maintain such papers 28 in place while utilizing the combination three pocket folder and document stand 10 in its document stand configuration, as generally depicted in FIG. 2, the first edge 19 of the first pocket 18 and the second edge 27 of the second pocket 25—each identified edge 19, 27 being an edge that will, in the document stand configuration, be positioned adjacent to the base panel 28—should be formed to run substantially the full distance between the top edge 34 and the bottom edge 35 of the combination three pocket folder and document stand 10. On the other hand, the top of the second edge 20 of the first pocket 18 and top of the first edge 26 of the second pocket 25 will preferably lie in about the middle third of the distance between the top edge 34 and the bottom edge 35 of the combination three pocket folder and document stand 10, thereby facilitating access to papers 28 and the like when the pockets 18, 25 are utilized in the three pocket folder configuration. Because the base panel 28 is remains in the horizontal plane for each configuration of the combination three pocket folder and document stand 10, the third pocket 33 is generally conventionally formed, to wit the full top edge of the third pocket 33 will also preferably lie in about the middle third of the distance between the top edge 34 and the bottom edge 35 of the combination three pocket folder and document stand 10.

In order that the combination three pocket folder and document stand 10 may be sturdily configured as a document stand, which, it is noted, is sufficiently structurally sound as to also safely and reliably support books, portable electronic devices and all manner of like articles, Applicants have devised a novel and inventive means for securing the combination three pocket folder and document stand 10 in its document stand configuration. To this end, and as will be better understood further herein, a flap 13 is also dependently provided adjacent the first edge 12 of the first rising panel 11. As also will be better understood further herein, the provided flap 13 comprises a plurality of accordion folds 14 and, at its distal edge, an elongate tab 15. Operatively cooperating with the provided flap 13, a slot 31, which is sized and shaped to receive therein the distal tab 15 of the flap 13, is provided along the second edge 30 of the base panel 28.

Figure 3:
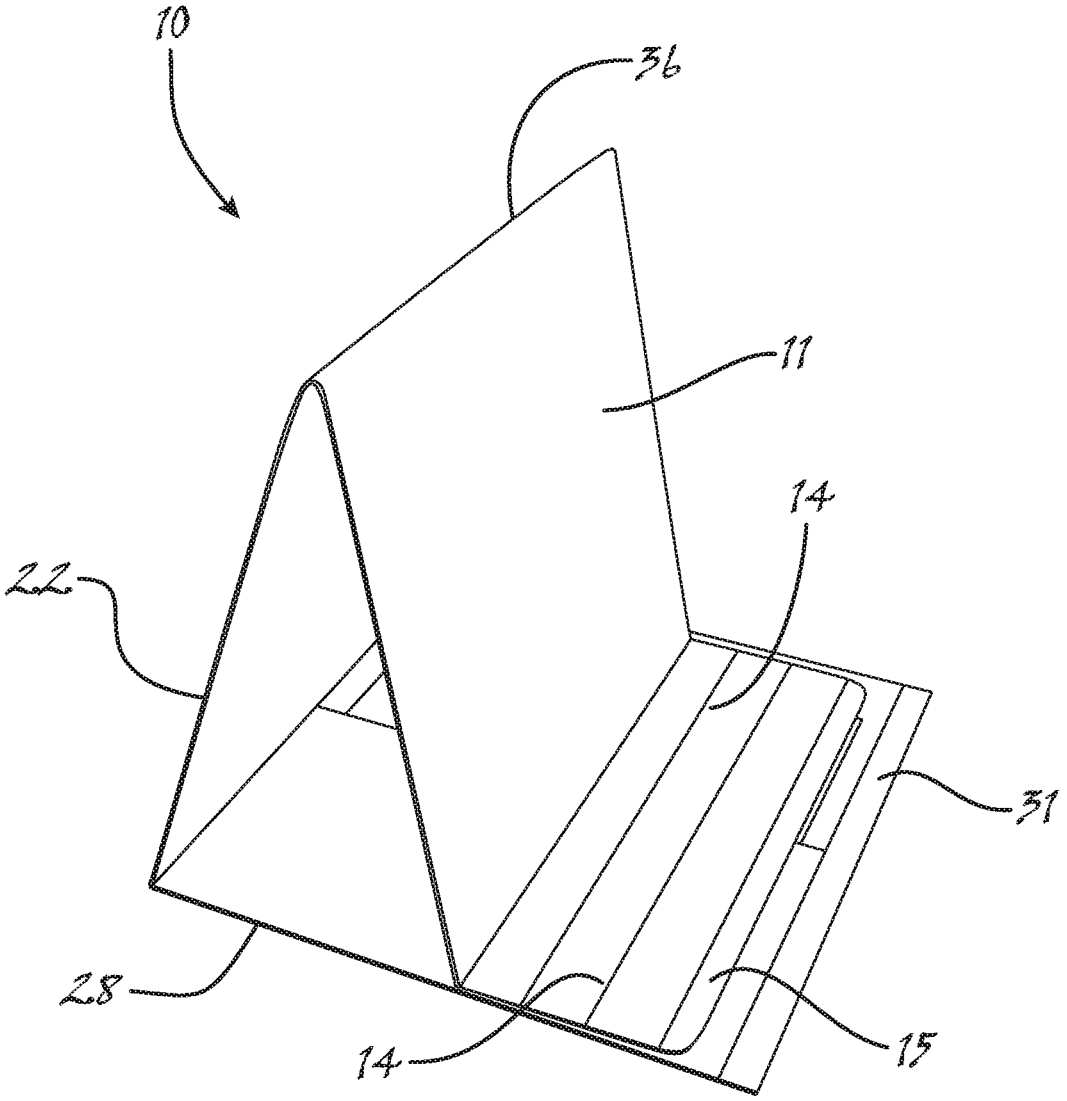
FIG. 3 shows, in a perspective view, various aspects of the deployment of the combination three pocket folder and document stand of the present invention for use in its document stand configuration.
Figure 4:
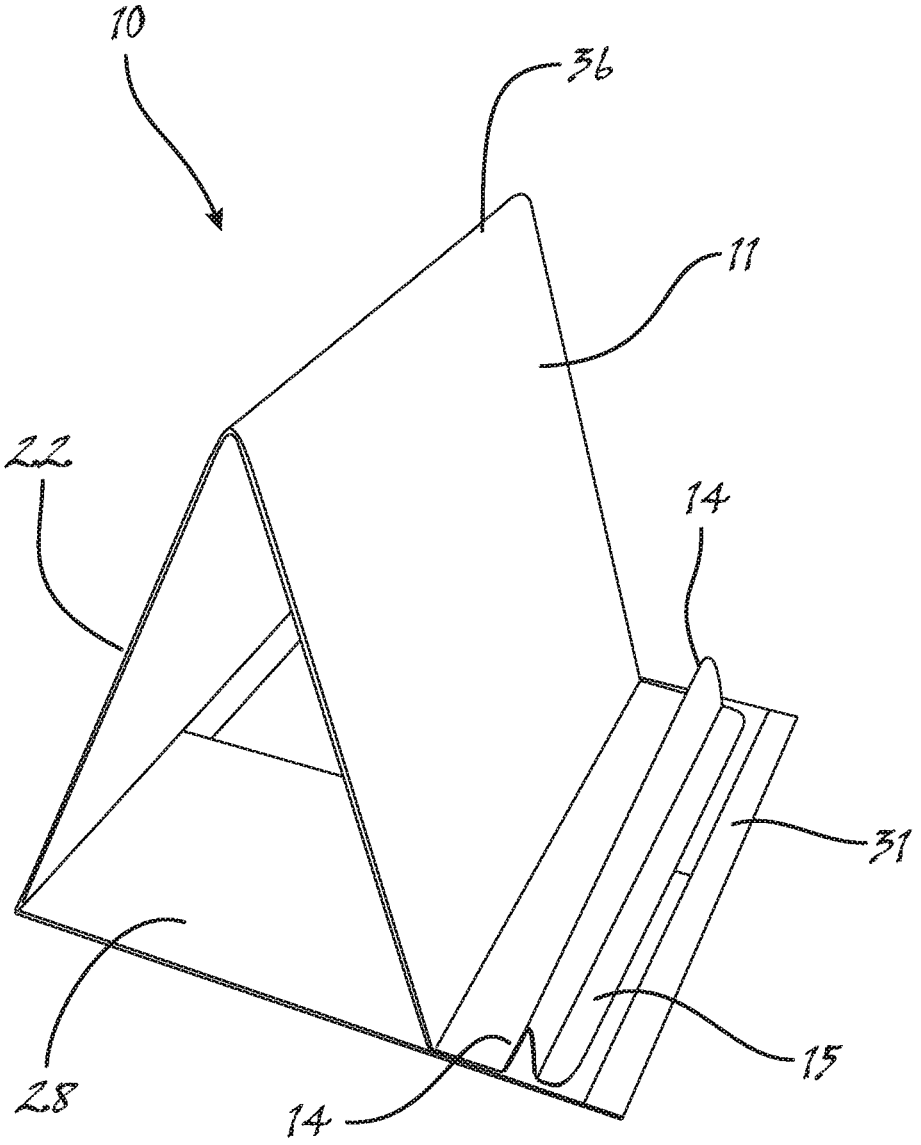
FIG. 4 shows, in a perspective view, various additional aspects of the deployment of the combination three pocket folder and document stand of the present invention for use in its document stand configuration.

Turning then to FIGS. 3 and 4, in addition to FIG. 2, conversion of the three pocket folder and document stand 10 from its document folder configuration to its document stand configuration is shown to generally begin with folding the first rising panel 11 and the second rising panel 22 up and over the base panel 28 to produce the elevated apex 36 of the document stand configuration, as shown in FIG. 3. At this point, the accordion folds 14 of the flap 13 are worked, as generally shown in FIG. 4, and the tab 15 of the flap 13 is inserted in place within the tab slot 31, as generally shown in FIG. 2, thereby forming a document tray 27, which may be utilized to support one or more papers 38 or like articles of sheet stock, a portable electronic device, a book, or any like article.

Figure 5:
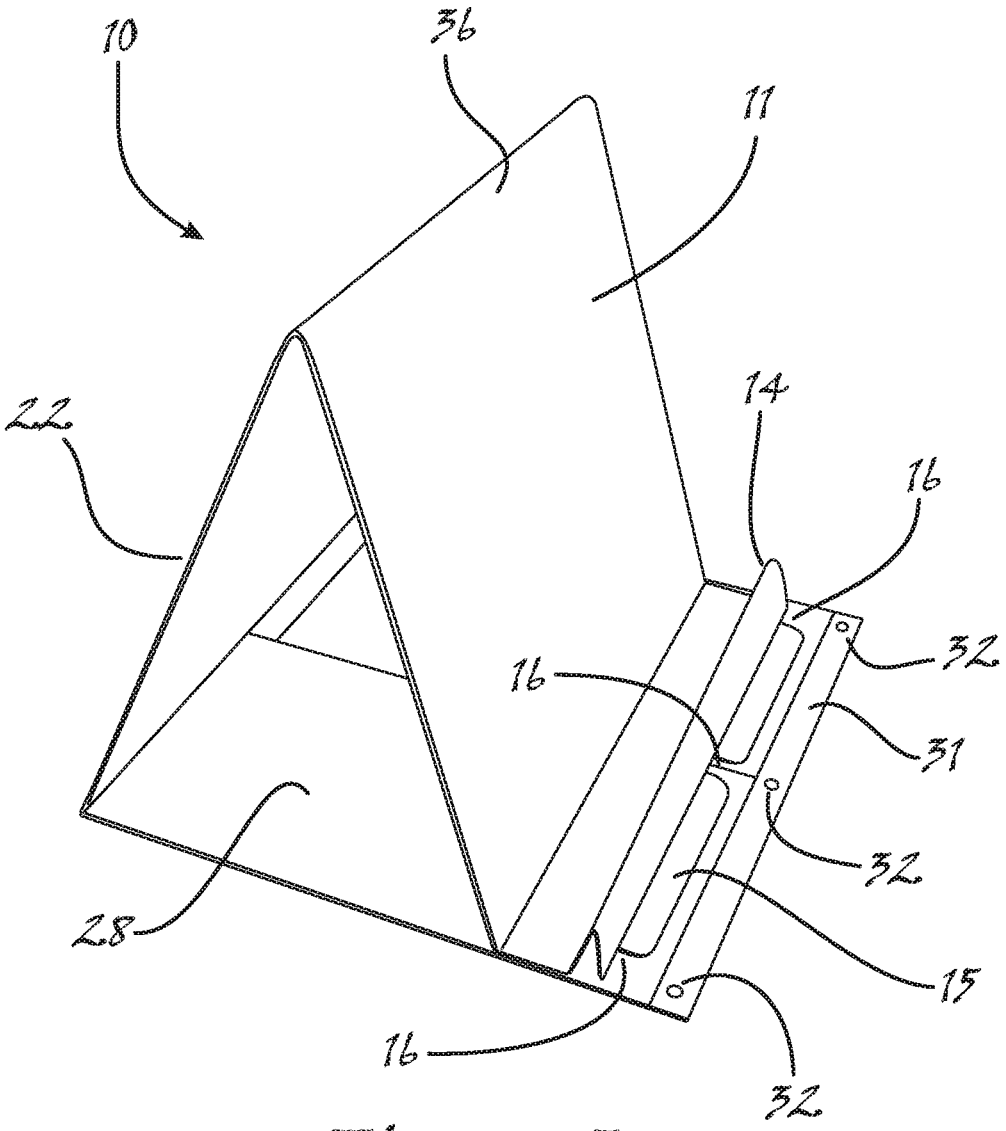
FIG. 5 shows, in a perspective view, an extension of the preferred implementation of the document stand configuration of the combination three pocket folder and document stand of the present invention.

Although Applicant has found that the described structure is unexpectedly sturdy, and, even when constructed of paper material bonding with glues or the like, is capable of supporting such weighty electronic devices as tablet computers, it may nonetheless in at least some cases be desirable to provide one or more reinforcements 32 for the tab slot 31. As depicted in FIG. 5, such reinforcements 32 may comprise brads, rivets or the like. If provided, however, it is noted that the table of 15 of the flap 13 may require the provision of recesses 16 to accommodate the added structure. It is also noted that in at least some implementations of the three pocket folder and document stand 10 of present invention, the folding panels 11, 22, 28, together with other features of the present invention, may comprise such materials as plastics, which may be radio frequency ("RF") welded; aluminum or other metals, which may be joined with piano or other style hinging; or any number of other materials, which materials may, in light of this exemplary description, be chosen for their suitability.

Figure 6:
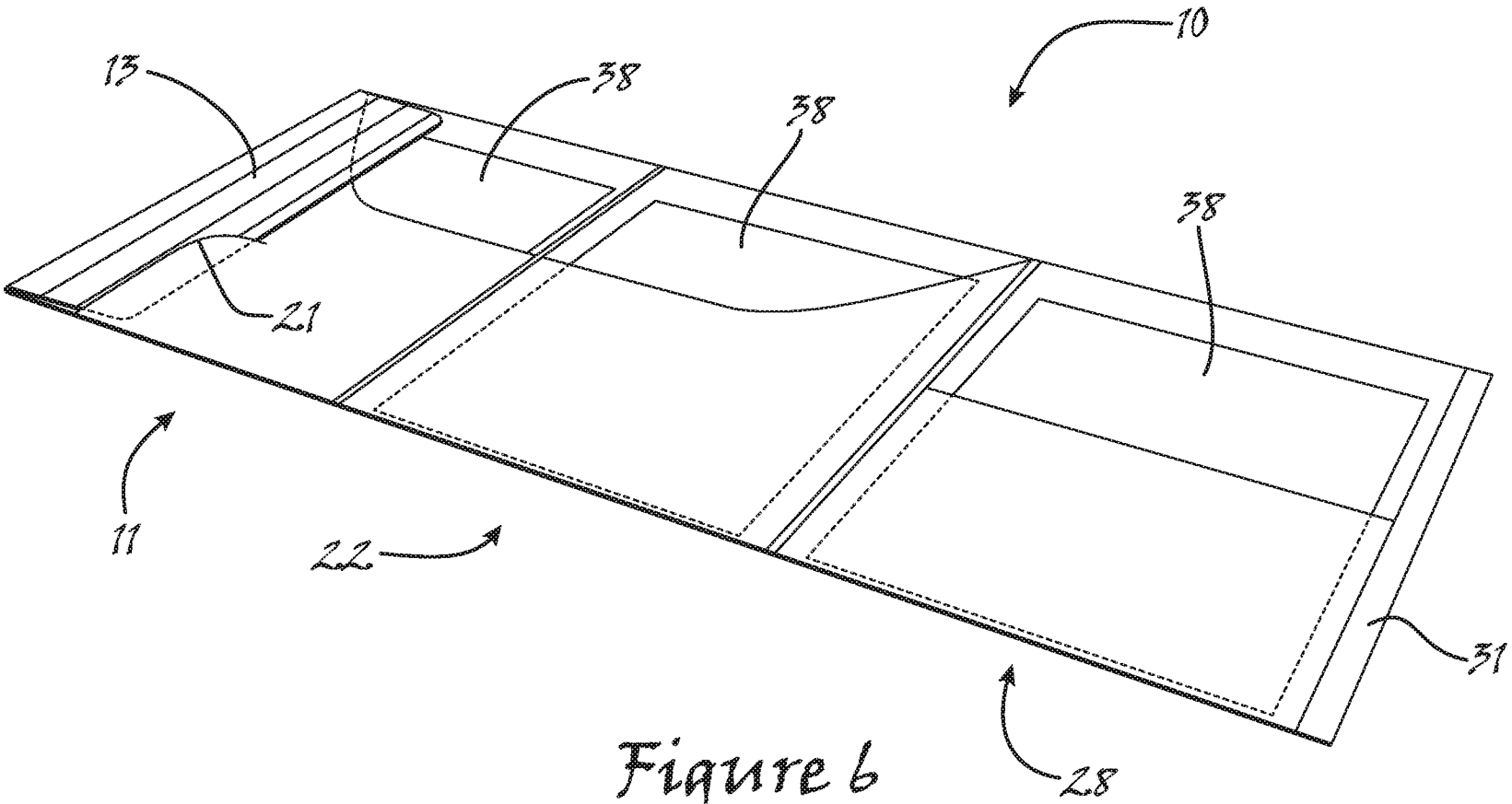
FIG. 6 shows, in a perspective view, the combination three pocket folder and document stand of the present invention, as utilized in one aspect of its document folder configuration.
Figure 7:
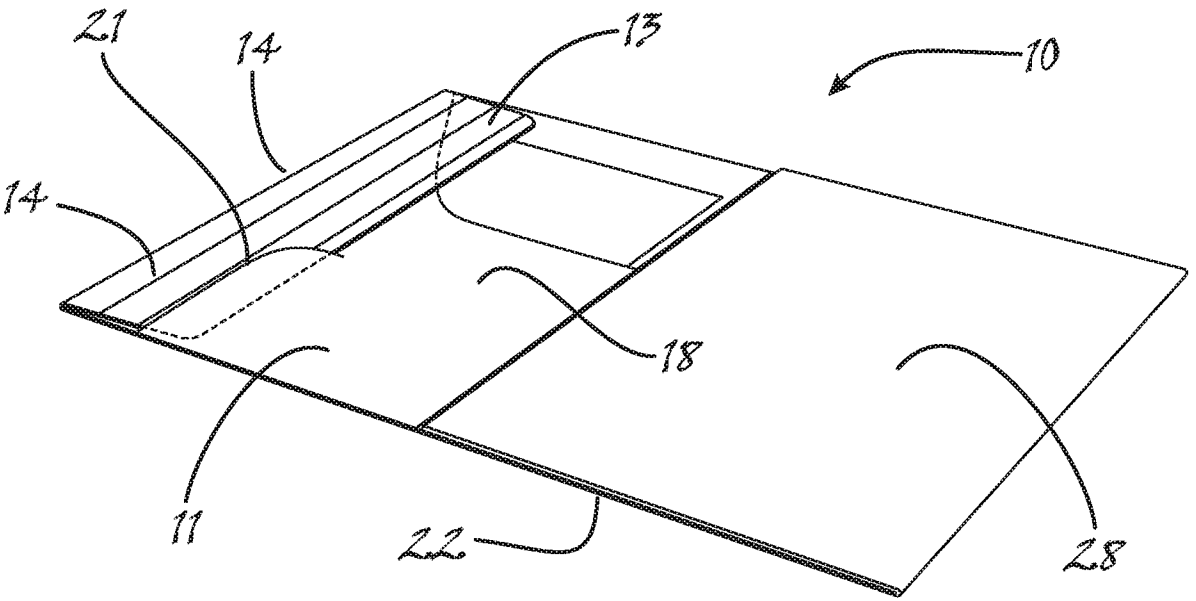
FIG. 7 shows, in a perspective view, the combination three pocket folder and document stand of the present invention, in transition between aspects of its document folder configuration.
Figure 8:
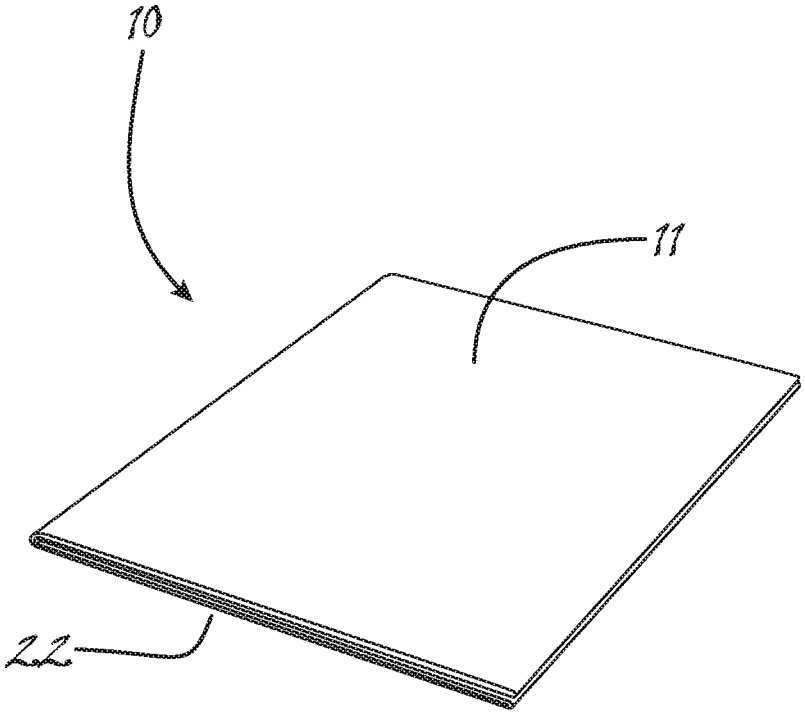
FIG. 8 shows, in a perspective view, the combination three pocket folder and document stand of the present invention, as utilized in a second aspect of its document folder configuration.

Returning then to the document folder configuration of the three pocket folder and document stand 10 of present invention, it is noted that the present invention contemplates a structure that, when not utilized in the document stand configuration, may be as much as possible be utilized as is otherwise conventional. To this end, as particularly shown in FIGS. 6 through 8, the three pocket folder and document stand 10 of present invention may be folded into a compact package for transportation and/or storage. As shown in FIG. 6, a slit 21 may be provided in the first pocket 18 to keep the flap 13 tucked away when not needed for the document stand configuration. In any case, as shown in FIGS. 7 and 8, the three pocket folder and document stand 10 of present invention otherwise folds as is conventionally known with respect to other three pocket style folders.

While the foregoing description is exemplary of the preferred embodiment of the present invention, those of ordinary skill in the relevant arts will recognize the many variations, alterations, modifications, substitutions and the like as are readily possible, especially in light of this description, the accompanying drawings and claims drawn thereto. For example, it will be appreciated by those of ordinary skill in the art that features otherwise conventional in the document folder arts may be readily integrated with the innovative three pocket folder and document stand 10 of present invention. For example, those of ordinary skill in the art will recognize that additional pockets, pencil holders and the like may be affixed to or otherwise provided in connection with the described pockets 18, 25, 33 or other structures of the three pocket folder and document stand 10. In any case, because the scope of the present invention is much broader than any particular embodiment, the foregoing detailed description should not be construed as a limitation of the scope of the present invention, which is limited only by the claims appended hereto.

What is claimed is:

1. A combination multiple pocket folder and document stand, said folder and document stand comprising:

a first rising panel having a first edge and a second edge;

a second rising panel, having a first edge attached to said second edge of said first rising panel and a second edge;

a base panel, having a first edge attached to said second edge of said second rising panel and a second edge;

a flap extending from said first edge of said first rising panel, and having a tab formed along a distal edge of said flap; and wherein:

said base and rising panels cooperatively define a top edge and a bottom edge of a document folder;

each said rising panel comprises a pocket adapted to dependently receive therein a quantity of sheet stock;

at least an edge of said pocket of said first rising panel adjacent said first edge of said first rising panel and at least an edge of said pocket of said second rising panel adjacent said second edge of said second rising panel run a distance between said top edge and said bottom edge of said document folder; and said folder and document stand is transformable between a first, folder configuration and a second, document stand configuration, where, in said second, document stand configuration:

said tab of said flap is received within a slot formed in said base panel adjacent said second edge of said base panel;

a junction of said first edge of said second rising panel and said second edge of said first rising panel defines an apex of a document stand; and said flap comprises accordion folds, said accordion folds being adapted to form a document tray of said document stand.

* * * * *